US006457842B1

(12) United States Patent
Ingrassia

(10) Patent No.: US 6,457,842 B1
(45) Date of Patent: Oct. 1, 2002

(54) HOLIDAY LIGHTS LINE SWITCH

(76) Inventor: Vito A. Ingrassia, 4028 Belleaire La., Downers Grove, IL (US) 60515

( * ) Notice: Subject to any disclaimer, the term of this patent is extended or adjusted under 35 U.S.C. 154(b) by 55 days.

(21) Appl. No.: 09/791,516

(22) Filed: Feb. 23, 2001

(51) Int. Cl.[7] ..... F21V 23/04
(52) U.S. Cl. ..... 362/251; 362/806; 200/52 R
(58) Field of Search ..... 362/251, 226, 362/249, 250, 252, 806; 200/52 R

(56) References Cited

U.S. PATENT DOCUMENTS 5,453,664 A 9/1995 Harris
5,580,159 A 12/1996 Liu
5,646,383 A * 7/1997 Deem ..... 362/806
5,816,686 A 10/1998 Wang et al.
5,860,731 A 1/1999 Martinez

* cited by examiner

*Primary Examiner*—Stephen Husar
(74) *Attorney, Agent, or Firm*—Knechtel Demeur & Samlan

(57) ABSTRACT

A method and apparatus for controlling a string of miniature holiday lights in which the string of lights is provided with a miniature light switch. The light string has a plurality of miniature sockets electrically connected in series. The switch is mounted in one of the sockets and can turn on and off the lamps connected in series on that string of lights. The switch and lamps have substantially identical bases that are received in the sockets so that the switch is interchangeable with any of the lamps allowing the switch to be placed anywhere along the light string. This gives the user the ability to control a string of lights without unplugging the string of lights from the power source. It also allows the user to place the switch in a convenient location along the light string.

19 Claims, 3 Drawing Sheets

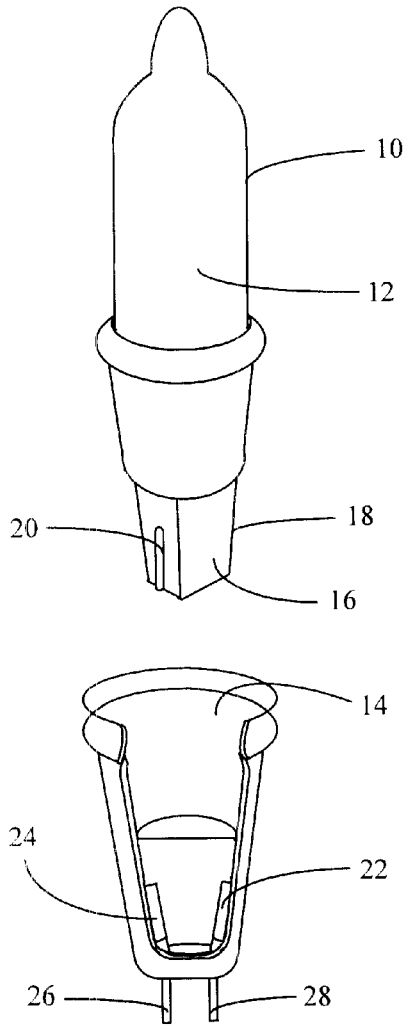
-Fig 1
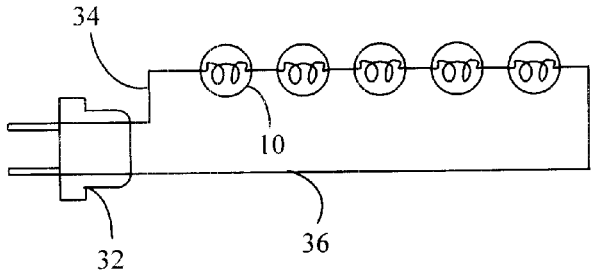
-Fig 2

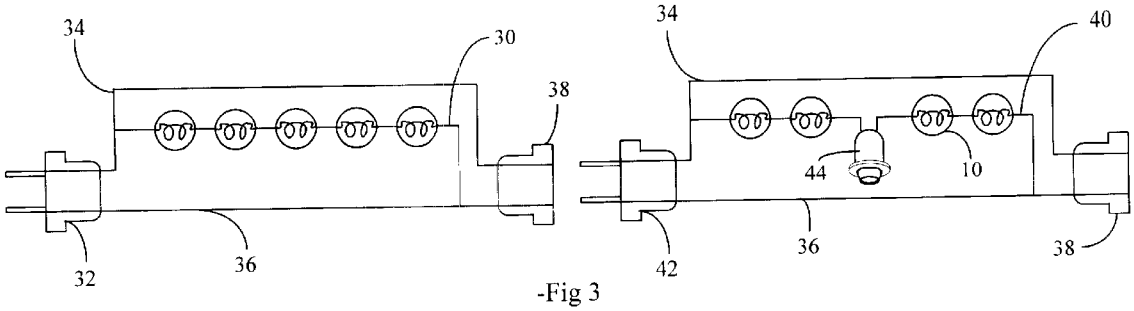
-Fig 3

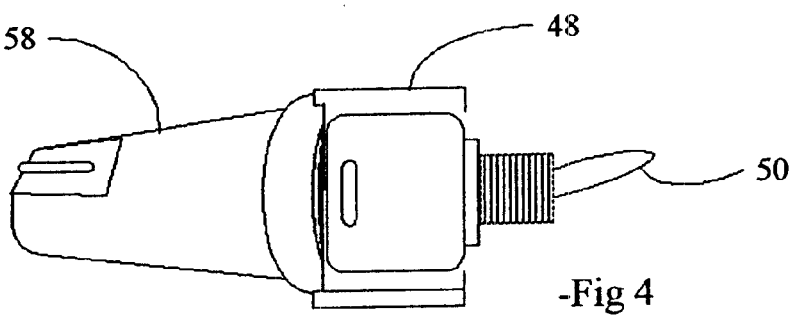
-Fig 4
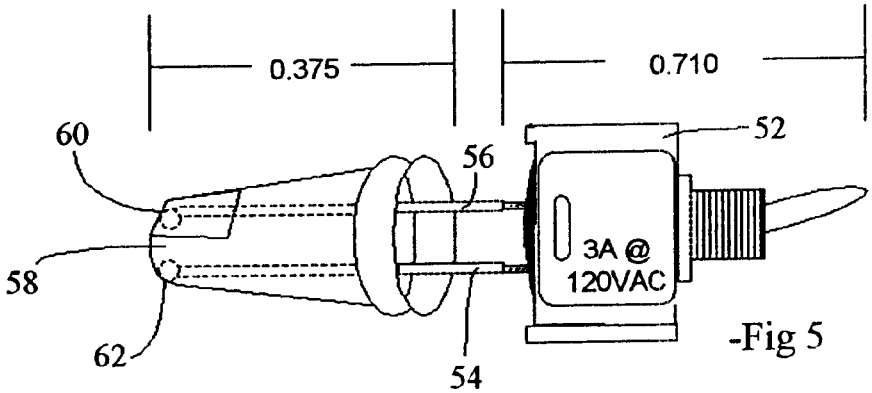
-Fig 5
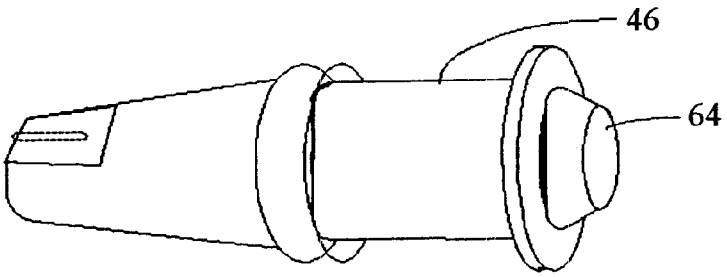
-Fig 6
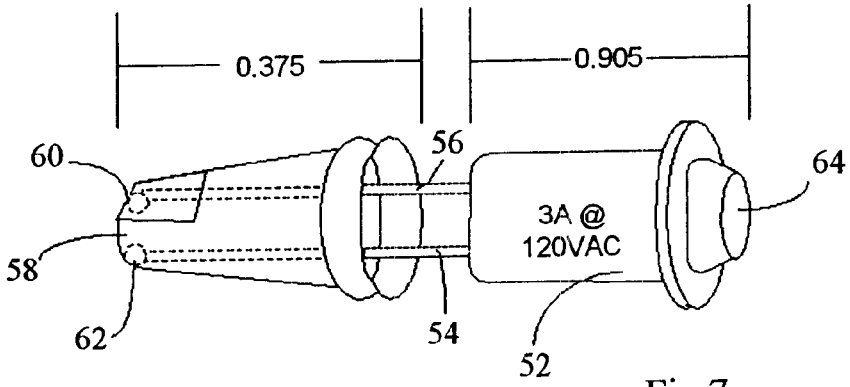
-Fig 7

HOLIDAY LIGHTS LINE SWITCH

BACKGROUND AND SUMMARY OF THE INVENTION

This invention relates to decorative lighting and more particularly to miniature light strings used in various decorative settings. It is more particularly related to a new and unique method for turning the light string on and off.

There are known various types of miniature light strings or light sets. Examples of miniature lights and displays can be found in U.S. Pat. No. 5,453,664 to Harris, U.S. Pat. No. 5,624,181 to Miller et al. and U.S. Pat. No. 5,860,731 to Martinez. These strings of lights are often used during holiday times for decorative Christmas tree light strings. Another use is a light string used to frame a window with a series of miniature lights. Still another application is to wrap a string of miniature holiday lights around a wreath that is in turn hung on a wall. The miniature light sets include a plurality of light sockets disposed along and electrically connected to an electrical wire or conductor. A miniature bulb is mounted in each socket.

In standard household applications, the voltage available is 120 volts A.C. For an extended length of lights, such as used on Christmas trees or other extended length applications, the miniature bulbs are generally 2.5 volt incandescent bulbs. So that the bulbs will operate in this environment, a standard string of miniature lights has fifty bulbs that are connected in series. Thus there is approximately a 2.5 volt drop across each bulb. In a series connection, if one bulb fails, the entire string goes out unless there is a shunt to maintain the other bulbs lit. The shunt keeps current running through the socket in the even that the bulb bums out.

At one end of the string of lights is a male plug that is adapted to be plugged into a wall outlet. In the conventional light string set, the string of miniature lights is turned on and off by simply plugging or unplugging the end of the cord into and out of the wall outlet. In some applications this is acceptable and does not present a problem for the user. However, in some homes or businesses there may be ten or twenty different strings of lights connected to one wall outlet. A problem arises when there is a need to turn off only one or a few selected strings of lights. This may happen when the user selects to only turn off lights around a wreath, while leaving other lights on. At other times, the outlet is hidden or not easily accessible. This makes it difficult to get to the plug to remove it from the outlet to operate the lights each time the light string is to be turned on or off. This becomes more prevalent when the user has numerous strings of lights and one outlet will overload if everything is plugged into it. In order to divide the electrical load, more than one outlet is used and the additional outlet may be remote or difficult to reach.

In these instances it is a great convenience to have a means to disconnect only selected strings of lights without disrupting other strings of lights. It is also a great convenience if the means to disconnect the selected string is placed anywhere on the string of miniature lights so that the user can selectively position the disconnect means. Heretofore there was never any such means that could be added to a conventional string of miniature lights to provide an on off switch along the string of lights.

OBJECTS AND ADVANTAGES OF THE INVENTION

Thus it is an object of the invention to provide a switch on a miniature light string so that the light string can be turned on and off without the need to unplug the light string from the power source.

It is a related object to provide a switch on a light string that can be located at various locations along the light string.

Another object is to provide a switch that can be operatively placed in any bulb receiving socket along the light string.

Still another object is to provide a switch that is simple in construction, inexpensive to manufacture and easy to use.

SUMMARY OF THE INVENTION

The present invention comprises a method and apparatus for providing an electrical on off switch along a string of miniature lights. The electrical switch is mounted in any socket that normally holds a miniature bulb. The bulb is removed and the switch is mounted in its place. The switch has a base that is substantially identical to the bulb's base so that the switch contacts make electrical contact with the socket contacts. This allow current to flow through the switch when the switch is in its closed position. When the switch is placed in its open position, it breaks the flow of electricity and turns off all of the bulbs connected in series on the string of lights. The switch has a base that can be mounted in any of the bulb sockets, depending on the location chosen by the user. The switch can be of any conventional design such as push button or toggle switch. Once the switch is mounted in the socket it can turn on and off all of the miniature lights connected in series on the string of lights.

DESCRIPTION OF THE DRAWINGS

FIG. 1 is an exploded view showing a conventional miniature lamp and socket assembly.

FIG. 2 is an electrical schematic diagram of a standard string of miniature lights connected in series.

FIG. 3 is an electrical schematic diagram of a standard string of two strings of miniature lights adapted for connection in parallel, while the lights in each string are connected in series.

FIG. 4 is a perspective view of a toggle type switch that is dimensioned to be received in the socket on the string of lights.

FIG. 5 is an exploded view of the switch of FIG. 4.

FIG. 6 is a perspective view of a pushbutton type switch that is dimensioned to be received in the socket on the string of lights.

FIG. 7 is an exploded of the switch of FIG. 6.

DETAILED DESCRIPTION OF THE PREFERRED EMBODIMENT

Turning first to FIG. 1 there is illustrated a conventional miniature light or lamp 10. The lamp 10 has a miniature bulb 12 that is received in a socket 14. There is a base 16 at the bottom of the bulb 12. Extending from opposite sides of the base 16 are a pair of bulb wires 18, 20. These are connected to a filament in the bulb 12. The socket 14 has a pair of terminals 22, 24 that make electrical contact with the bulb wires 18, 20 when the bulb is inserted into the socket 14. The terminals are electrically connected to a pair of terminal wires 26, 28 that are connected to a power source.

FIG. 2 is a schematic diagram of a conventional string of miniature holiday lights 30. There is an electrical plug 32 that is designed to be plugged into a standard wall outlet. Normally the household voltage supplied in the United States is 120 volts A.C. Two conductor wires 34 and 36 exit the wall plug 32. The conductor wire 34 has a plurality of miniature lights or lamps 10 connected in series along the conductor wire. There are generally fifty miniature lamps each rated 2.5 volts along the wire 34. This results in a drop of approximately 2.5 volts across each lamp. The light string can use other lamps with different voltages and differing numbers of lamps, but the concept of connecting the lamps in series remains the same. In this configuration, when one bulb 12 burns out, all of the lamps connected in series along the wire 34 go out.

FIG. 3 illustrates a second configuration of miniature holiday light strings in which there is provided the possibility of connecting additional strings of lamps to the previous string. The string of miniature lamps 30 is provided with a wall plug 32 and an end plug 38. The wire 34 is connected to one receiving slot in the end plug 38. The other conductor wire 36 is connected to another slot in the end plug 38. Each slot in the end plug 38 is provided with electrical conductor strips. Another string of miniature lamps 40 is adapted to be plugged into the string 30. The wall plug 42 is plugged into end plug 38. The other end of the string 40 terminates in another end plug 38, which can receive yet another string of lights.

The string 30 has the conductor wires 34 and 36 electrically connected to the plug 12. The conductor wire 34 has a series of lamps 10 connected in series. The string 40 is similar to the string 30 except that there is also provided a switch 44. The switch is of any conventional type such as a pushbutton switch 46 or toggle switch 48. FIGS. 4 and 5 show the miniature toggle switch 48. There is a toggle 50 that causes internal contacts (not illustrated) within the housing 52 to connect or disconnect. The contacts are connected to wires 54, 56 located in a base 58 of the switch. The wires 54, 56 terminate at electrically exposed ends or terminals 60, 62 in the base 58. FIGS. 5 and 6 show the miniature pushbutton switch 46. Instead of a toggle 50 there is a pushbutton 64 that causes the internal contacts to connect or disconnect. The other portions of the switch 46 are similar to the switch 48 and the same reference numbers have been used.

As seen in FIG. 3, the switch 44 is placed in one of the sockets 14. It replaces one of the bulbs 12, which is removed from its socket. The switch 44 is connected in series along the wires 34 and 36. Thus, when the switch 44 is turned to the "off" position, it's internal contacts open, which opens the circuit. This turns all the lights 10 off in the string 40. When the switch 44 is turned on, the contacts close, which closes the circuit and turns on all the lights 10. The switch can be either the toggle switch 48, pushbutton switch 46 or any other type of electrical switch that can be adapted to fit into the socket 14. The switch 44 must be rated for the electrical load that it may experience. Thus it should be rated for at least three or four strings of lights connected in series.

The switch 44 has a base 58 that fits snugly into the socket 14. The exposed ends 60, 62 are placed on the base 58 in a location that results in the exposed ends or terminals 60, 62 making electrical contact with the terminals 22, 24 in the socket 14. This allows the switch to complete the electrical circuit to the lights in the light string. The switch can be placed in any of the sockets 14 along the light string 30 or 40. To do this the selected lamp 10 is removed from its socket 14. The lamp 10 that is chosen can be anywhere along the light string 30 or 40. The switch 44 is inserted in place of the removed lamp. This is preferably done with the light string unplugged from its power source. Then after the switch is inserted, the string can be plugged into the wall outlet. If the switch 44 is in the on position, the bulbs 12 in the string 30 or 40 will turn on. They can be turned off by either unplugging the wall plug 12 from the outlet, or more preferably, by turning the switch 44 to the off position. This allows the user to turn the light string 30 or 40 on and off without unplugging the light string from the wall outlet. By placing the switch 44 in a convenient position along the light string, it makes it easy for the user to control the light string. Furthermore, the user can move the switch 44 to any socket along the light string by removing any selected lamp 10 and inserting the switch 44 in its place.

Thus there has been provided a method and apparatus for turning a light string of miniature lights on and off that fully satisfies the objects and advantages as set forth above. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A method for controlling a string of miniature electrical lights comprising the steps of:

(a) providing a plurality of miniature sockets, each socket having disposed therein a miniature lamp, the socket and its respective lamp connected in a series circuit;

(b) removing one of the lamps from its socket;

(c) inserting an electrical switch into the socket from which the lamp was removed;

(d) electrically connecting the electrical switch in the series circuit with the plurality of miniature sockets and the lamps disposed therein; and (e) operating the switch to selectively open or close the series circuit to turn on or off all of the lamps connected in the series circuit in unison.

2. The method of claim 1 and the further step of providing the electrical switch with a base adapted to be received in the socket from which the lamp is removed.

3. The method of claim 2 and the further step of electrically connecting the string of lights to a power source.

4. The method of claim 2 and the further step of providing a toggle operated switch as the electrical switch.

5. The method of claim 2 and the further step of providing a pushbutton operated switch as the electrical switch.

6. The method of claim 2 wherein the step of electrically connecting the electrical switch in the series circuit with the plurality of miniature sockets and respective lamps is accomplished by inserting the electrical switch into the socket.

7. A method for controlling a string of miniature electrical lights comprising the steps of:

(a) providing a plurality of miniature sockets that are electrically connected in a series circuit;

(b) providing an electrical switch in one socket;

(c) electrically connecting the electrical switch in the series circuit with the plurality of miniature sockets;

(d) providing miniature lamps in all of the remaining sockets in the string of miniature electrical lights;

(e) electrically connecting the miniature lights in the series circuit with the plurality of miniature sockets; and (f) operating the switch to selectively provide electrical power to the miniature sockets.

8. The method of claim 7 and the further step of mounting the electrical switch in the one socket by means of a base that is adapted for removable mounting from the one socket.

9. The method of claim 7 and the further step of electrically connecting the string of lights to a power source.

10. The method of claim 7 and the further step of providing a toggle operated switch as the electrical switch.

11. The method of claim 7 and the further step of providing a pushbutton operated switch as the electrical switch.

12. The method of claim 7 wherein the step of electrically connecting the electrical switch in the series circuit with the plurality of miniature sockets and respective lamps is accomplished by inserting the electrical switch into the socket.

13. A light string having a plurality of lights connected in a series circuit comprising:

a plurality of lamp sockets, each socket having an interior and a first and second socket electrical wire extending through the socket and into the socket interior, first and second socket electrical contacts within the interior or each socket, the first and second socket electrical wires electrically connected to the first and second socket electrical contacts respectively, a removable electrical switch mounted in one of the lamp sockets, the removable switch having a first and second switch terminal positioned on the switch, the first and second switch terminals electrically connected to the first and second socket electrical contacts when the switch is mounted in the socket, a miniature lamp mounted in each of the remaining lamp sockets not having the electrical switch mounted therein, each lamp having first and second lamp wires positioned on the lamp, the first and second lamp wires electrically connected to the first and second socket electrical contacts when the lamp is mounted in the socket, and a power line for electrically connecting the socket electrical wires in a series circuit, and a plug electrically connected to the power line for electrically connecting the power line to a power source.

14. The light string of claim 13 wherein the removable electrical switch comprises a manually operable electrical contact that is selectively operated between an open and a closed position, the electrical contact electrically connected in the series circuit.

15. The light string of claim 14 wherein the electrical switch is a toggle operated electrical switch.

16. The electrical string of claim 14 wherein the electrical switch is a pushbutton operated electrical switch.

17. The light string of claim 13 and further comprising a switch base on each electrical switch, the base having the first and second switch terminals mounted thereon.

18. The light string of claim 17 and further comprising a lamp base on each lamp, the lamp base having the first and second lamp wires mounted thereon.

19. The light string of claim 18 wherein the switch base and lamp base are substantially the same size and are interchangeable so that any lamp is interchangeable with the switch, thereby allowing the switch to be placed in any socket along the light string.

* * * * *